US010144108B2

(12) United States Patent
Zhou et al.

(10) Patent No.: US 10,144,108 B2
(45) Date of Patent: Dec. 4, 2018

(54) AUTOMATED POLISHING SYSTEM AND METHOD

(71) Applicant: Guangdong Institute of Intelligent Manufacturing, Guangzhou, Guangdong (CN)

(72) Inventors: Xuefeng Zhou, Guangzhou (CN); Dan Huang, Guangzhou (CN); Xiaoming Jiang, Guangzhou (CN); Kaige Li, Guangzhou (CN); Xiaoguang Liu, Guangzhou (CN); Taobo Cheng, Guangzhou (CN)

(73) Assignee: Guangdong Institute of Intelligent Manufacturing (CN)

( * ) Notice: Subject to any disclaimer, the term of this patent is extended or adjusted under 35 U.S.C. 154(b) by 277 days.

(21) Appl. No.: 14/888,029

(22) PCT Filed: Oct. 24, 2014

(86) PCT No.: PCT/CN2014/089450
§ 371 (c)(1),
(2) Date: Oct. 29, 2015

(87) PCT Pub. No.: WO2016/045161
PCT Pub. Date: Mar. 31, 2016

(65) Prior Publication Data

US 2016/0250734 A1 Sep. 1, 2016

(30) Foreign Application Priority Data

Sep. 22, 2014 (CN) ..... 2014 1 0487297

(51) Int. Cl.
*B24B 37/11* (2012.01)
*B24B 41/06* (2012.01)
(Continued)

(52) U.S. Cl.
CPC ..... *B24B 37/11* (2013.01); *B24B 7/075* (2013.01); *B24B 7/16* (2013.01); *B24B 27/0023* (2013.01);
(Continued)

(58) Field of Classification Search
CPC ..... B24B 51/00; B24B 13/01; B24B 37/345
(Continued)

(56) References Cited

U.S. PATENT DOCUMENTS 5,618,222 A 4/1997 Baima et al.
5,785,578 A * 7/1998 Thoresen ..... B24B 7/228 451/14
(Continued)

FOREIGN PATENT DOCUMENTS

CN 1110207 A 10/1995
CN 101004504 A 7/2007
(Continued)

OTHER PUBLICATIONS

International Search Report and Written Opinion for Application No. PCT/CN2014/089450 dated Jun. 29, 2015.
(Continued)

*Primary Examiner* — Monica Carter
*Assistant Examiner* — Lauren Beronja
(74) *Attorney, Agent, or Firm* — Lerner, David, Littenberg, Krumholz & Mentlik, LLP

(57) ABSTRACT

An automated polishing system includes a workbench, a transport unit and a polishing unit, wherein the transport unit is provided with a transport surface and a transport drive configured to drive the transport surface to move horizontally, and the polishing unit includes a supporting portion, a holding arm rotatably connected to the supporting portion, a holder connected to the holding arm, a horizontal drive configured to drive the supporting portion to move horizon-
(Continued)

tally, a vertical drive configured to drive the supporting portion to move vertically, a horizontally rotating drive configured to drive the holding arm to rotate in a horizontal direction, a vertically rotating drive configured to drive the holder to rotate in a vertical direction, a polishing shaft, a polishing rotating device configured to drive the polishing shaft, and a polishing drive configured to drive the polishing shaft to move towards the holder for reciprocating motion.

8 Claims, 11 Drawing Sheets

(51) Int. Cl.

| | |
|---|---|
| ***B24B 27/00*** | (2006.01) |
| ***B24B 29/02*** | (2006.01) |
| ***B24B 41/00*** | (2006.01) |
| ***B24B 7/07*** | (2006.01) |
| ***B24B 7/16*** | (2006.01) |
| ***B24B 37/005*** | (2012.01) |
| ***B24B 37/27*** | (2012.01) |
| ***B24B 29/00*** | (2006.01) |

(52) U.S. Cl.
CPC ..... *B24B 27/0069* (2013.01); *B24B 29/00* (2013.01); *B24B 29/02* (2013.01); *B24B 37/005* (2013.01); *B24B 37/27* (2013.01); *B24B 41/005* (2013.01); *B24B 41/06* (2013.01)

(58) Field of Classification Search
USPC ..... 451/5, 11
See application file for complete search history.

(56) References Cited

U.S. PATENT DOCUMENTS

| | | | | |
|---|---|---|---|---|
| 5,895,311 | A * | 4/1999 | Shiotani | B23H 1/00 451/11 |
| 5,947,802 | A | 9/1999 | Zhang et al. | |
| 6,155,911 | A | 12/2000 | Mandler | |
| 6,250,995 | B1 * | 6/2001 | Hakomori | B24B 9/065 451/194 |
| 7,455,569 | B2 * | 11/2008 | Schafer | B24B 13/0037 451/11 |
| 2007/0293128 | A1 | 12/2007 | Schafer et al. | |
| 2008/0034797 | A1 | 2/2008 | Lee et al. | |
| 2012/0295516 | A1 * | 11/2012 | Guo | B24B 41/02 451/5 |
| 2015/0258652 | A1 * | 9/2015 | Becker | B24B 11/00 451/256 |

FOREIGN PATENT DOCUMENTS

| | | | |
|---|---|---|---|
| CN | 101088706 | A | 12/2007 |
| CN | 101209536 | A | 7/2008 |
| CN | 201198112 | Y | 2/2009 |
| CN | 201604066 | U | 10/2010 |
| CN | 102225528 | A | 10/2011 |
| CN | 202162681 | U | 3/2012 |
| CN | 203357201 | U | 12/2013 |
| CN | 203779307 | U | 8/2014 |
| CN | 204183372 | U | 3/2015 |

OTHER PUBLICATIONS

Second Office Action for Priority Chinese Patent Application No. 201410487297.9, dated May 4, 2016.
Third Office Action for Priority Chinese Patent Application No. 201410487297.9, dated Jun. 2, 2016.
Search Report & First Office Action for Priority Chinese Patent Application No. 201410487297.9, dated Mar. 2, 2016.

* cited by examiner

AUTOMATED POLISHING SYSTEM AND METHOD

CROSS-REFERENCE TO RELATED APPLICATIONS

The present application is a national phase entry under 35 U.S.C § 371 of International Application No. PCT/CN2014/089450 filed Oct. 24, 2014, which claims priority from Chinese Application No. 201410487297.9 filed Sep. 22, 2014, all of which are hereby incorporated herein by reference.

FIELD

The present invention relates to the field of metal surface treatment and, more specifically, to an automated polishing system and method.

BACKGROUND

There are various methods of metal surface polishing, in which mechanical polishing, chemical polishing and electrochemical polishing have a large market share in industrial production, and are usually used.

The mechanical polishing method is difficult to be widely popularized and used in the polishing industry of slight profit because of requiring huge investment on hardware devices and complex operations. A complex surface polishing is a process based on manual polishing, in combination with mechanical polishing wheel or belt polishing, which relies on the worker's proficiency and visual observation for controlling the polishing quality. Such process has a low stability, and the polishing environment where most workers operate is extremely harsh that the dust and vibration generated in the polishing process have a strong impact on the body and the environment. The manual mechanical polishing wheel is still used in some small workshops or manual workshops to achieve workpiece polishing. A method of batch polishing has be popularized in some large surface treatment enterprises, in which batches of parts and abrasive should be mixed with catalytic agent in proportion, and then put the mixture into a container , such as roller, to make the components of the mixture rub and crash against each other to achieve polishing. Such method has advantages of low labor intensity, high efficiency, low cost, independent of the worker's proficiency, stable quality and suits for the parts with various shapes, but it has a slightly poor smooth finish.

SUMMARY

Based on the above, it is necessary to provide an automated polishing system, which has good polishing effect, allows accurate polishing, can protect the worker's health at the largest degree, and is low in cost.

According to an aspect of the present invention, an automated polishing system is provided, including:

a workbench;

a transport unit, provided with a transport surface and a transport drive configured to drive the transport surface to move horizontally;

a polishing unit, fixed on the workbench, including a supporting portion, a holding arm rotatably connected to the supporting portion, a holder connected to the holding arm, a horizontal drive configured to drive the supporting portion to move horizontally, a vertical drive configured to drive the supporting portion to move vertically, a horizontally rotating drive configured to drive the holding arm to rotate in a horizontal direction, a vertically rotating drive configured to drive the holder to rotate in a vertical direction, a rotating drive configured to drive the holder to rotate relative to the holding arm, a polishing shaft, a polishing rotating device configured to drive the polishing shaft, and a polishing drive configured to drive the polishing shaft to move towards the holder for reciprocating motion; and a control unit, connected to the transport drive, the polishing rotating device, the polishing drive, the horizontal drive, the vertical drive, the horizontally rotating drive, the vertically rotating drive and the rotating drive.

The automated polishing system according to the present invention can automatically transport the object to be polished using the transport surface of the transport unit, hold up and fix the object to be polished using the holding arm and the holder of the polishing unit, and achieve a multi-angle and multi-plane rotation of the object to be polished using the horizontal drive, the vertical drive, the horizontally rotating drive and the vertically rotating drive, resulting in precise polishing and high accuracy. The automated polishing system can achieve the holding up of the object to be polished, the polishing and the feeding automatically, without human intervention, which can allow the worker to reduce direct contact with the polishing unit, avoid the direct short distance contact between the worker and the polishing material, and greatly protect the worker's health. The polishing equipment requires a low cost investment, and is low in cost, which can further save labor cost and time cost.

In one embodiment, the automated polishing system includes two polishing units which are arranged in order along a moving direction of the transport surface and separated from each other. With the configuration of the two polishing units, more than one surfaces of the object to be polished can be polished in one processing cycle, to solve the technical problem about time-consuming redundant operations for the polishing material in which a plurality of surfaces are required to be polished, and also shorten the time for the worker contacting with the machine. When the first polishing unit completes the polishing of one surface, the second polishing unit continues to implement the polishing of another surface, and the process between the switching from the first polishing unit to the second polishing unit requires no human intervention, which can be completed with the help of the holders and holding arms of the two polishing units. In this way, the worker's health can be further protected, the time can be further saved, and the polishing efficiency can be greatly improved.

In one embodiment, the automated polishing system further includes a turnover unit located between the two polishing units in a horizontal direction; and the turnover unit is provided with two connecting parts, and two guide rails which are fixed on the workbench through the connecting parts respectively, arranged above the transport surface, and separated from each other, and one end of each guide rail at the same end is curved upwards from a plane where the guide rails are located, so that the guide rails are in a shape of a diminishing curve along the moving direction of the transport surface. With the configuration of the turnover unit, it can achieve automatic turnover completely in a process when the first polishing unit has completed the polishing of one surface and the second polishing unit continues to implement the polishing of the another surface, without additional machine or device for turning over. That is, the automatic turn-over of the object to be polished can be implemented by the cooperation of the two guide rails of the turnover unit, and the horizontal drive, vertical drive, horizontally rotating drive and vertically rotating drive of the polishing unit, to save the cost of the investment on equipment.

In one embodiment, the transport surface of the transport unit includes a front end transport surface, a turnover transport surface and a material receiving transport surface; and the front end transport surface, the turnover transport surface and the material receiving transport surface are arranged in order in a horizontal direction, two polishing shafts are arranged between the front end transport surface and the turnover transport surface, and the turnover transport surface and the material receiving transport surface, respectively, and the two guide rails are arranged above the turnover transport surface. In this way, it facilitates the assembly and cooperation of the transport surface and the polishing shafts of the polishing units.

In one embodiment, each of the connecting parts of the turnover unit is provided with a retractable component configured to adjust the distance between the guide rails and the turnover transport surface, which facilitates the adjustment of the distance between the guide rails of the turnover unit and the transport surface.

In one embodiment, the head of the curved end of the two guide rails has a distance to the turnover transport surface larger than the thickness of the object to be polished, and a plane where the other end of the two guide rails are located, parallel to the transport surface, has a distance to the transport surface less than the thickness of the object to be polished, so that the object to be polished can be turned over when sliding along the curved end of the guide rails, and move forward, guided by the transport surface, after entering into the horizontal end of the guide rails.

In one embodiment, the distance between the two guide rails is less than the horizontal width of the object to be polished, so that the guide rails can support the object to be polished.

In one embodiment, the polishing unit further includes an air suction component, and the air suction component is provided with an air suction opening arranged at the end of the holder, so it facilities the holder to suck and hold the material to be polished.

In one embodiment, the holding arm is provided with two holding portions which are separated from each other, and the holder is hinged between the two holding portions through hinges, so that it facilities the mounting and rotating of the holder, and prevents the holder from slipping during the operation.

Another objective of the present invention is to provide an automated polishing method.

According to another aspect of the present invention, an automated polishing method is provided, including:

placing an object to be polished on a transport surface, and controlling, by a control unit, a transport drive to drive the transport surface to move;

controlling, by the control unit, a horizontal drive to drive a supporting portion to move horizontally to the top of the object to be polished, after the object to be polished being transported to a preset position, a vertical drive to drive the supporting portion to move downward till a holding arm of a polishing unit holding the object to be polished, the horizontal drive and the vertical drive to work together to drive the object to be polished to be transported to a position where a polishing shaft is, and the vertically rotating drive to drive a holder to rotate in a vertical direction to make a surface of the object to be polished face towards the polishing shaft;

controlling, by the control unit, a polishing drive to drive the polishing shaft to move for polishing, a polishing rotating device to drive the polishing shaft to rotate, the polishing drive to drive the polishing shaft to move towards the holder for reciprocating motion to make the surface to be polished of the object to be polished close to the polishing shaft; and controlling, by the control unit, the vertical drive and the horizontal drive to transport the object that has been polished to the transport surface, after polishing, the holding arm to return to its original position, the vertical drive and the horizontal drive to return to their original positions, and the polishing shaft to return to its original position.

The automated polishing method according to the present invention has advantages of simple equipment, convenient operation, and less labor, and it requires very little human intervention during polishing, which can reduce manual labor, greatly reduce the labor cost and protect the worker's health. In addition, the automated polishing method according to the present invention has high polishing accuracy and good polishing effect.

BRIEF DESCRIPTION OF THE DRAWINGS

The accompanying drawings illustrate one or more embodiments of the present invention and together with the written description, serve to explain the principles of the present invention. Wherever possible, the same reference numbers are used throughout the drawings to refer to the same or like elements of an embodiment.

DESCRIPTION OF REFERENCE NUMBERS

100, workbench; 200, 300, polishing unit; 201, 301, base; 202, 302, supporting portion; 203, 303, holding portion;

204, 304, holder; 205, 305, motor; 206, 306, polishing shaft; 208, 308, horizontal drive; 209, 309, vertical drive; 210, 310, horizontally rotating drive; 211, 311, vertically rotating drive; 400, front end transport surface; 401, turnover transport surface; 402, material receiving transport surface; 500, guide rail; 501, connecting portion; and 600 object to be polished.

DETAILED DESCRIPTION OF THE PREFERRED EMBODIMENTS

In the following description of embodiments, reference is made to the accompanying drawings which form a part hereof, and in which it is shown by way of illustration specific embodiments of the present invention that can be practiced. It is to be understood that other embodiments can be used and structural changes can be made without departing from the scope of the disclosed embodiments.

It will be understood that, when a feature or element is referred to as being "fixed" to another feature or element, it can be directly fixed to the other feature or element or intervening features or elements may be present. It will also be understood that, when a feature or element is referred to as being "connected", "attached" or "coupled" to another feature or element, it can be directly connected, attached or coupled to the other feature or element or intervening features or elements may be present.

Unless otherwise specified, all the terminology and scientific terms used herein have the same meaning as understood by those skilled in the art to which the present invention pertains. Terms used herein are for the purpose of describing particular embodiments only and are not intended to be limiting of the invention. For example, as used herein, the term "and/or" includes any and all combinations of one or more of the associated listed items.

Figure 1:
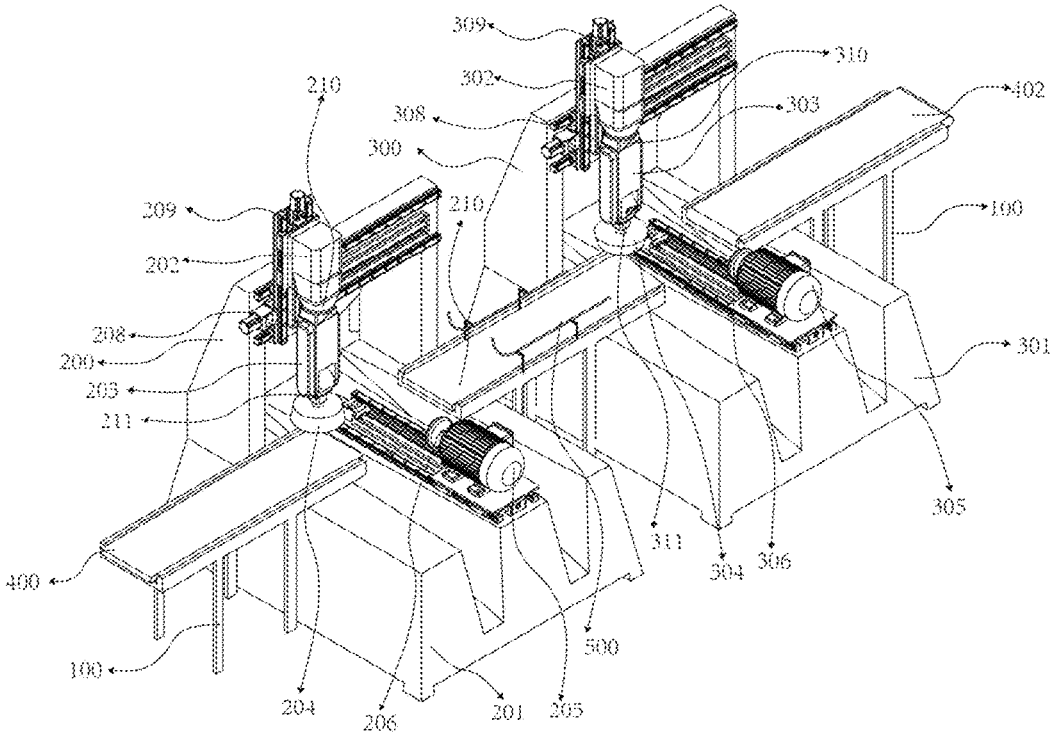
FIG. 1 is a schematic diagram illustrating an automated polishing system according to certain embodiments of the present disclosure.

As shown in FIG. 1, an automated polishing system is provided, including a workbench 100, a transport unit, a polishing unit 200 and a control unit (not shown).

The transport unit is fixed on the workbench 100, and provided with a transport surface and a transport drive configured to drive the transport surface to move horizontally. The transport surface of the transport unit includes a front end transport surface 400, a turnover transport surface 401 and a material receiving transport surface 402, and the front end transport surface, the turnover transport surface and the material receiving transport surface are arranged in order in a horizontal direction.

Figure 2:
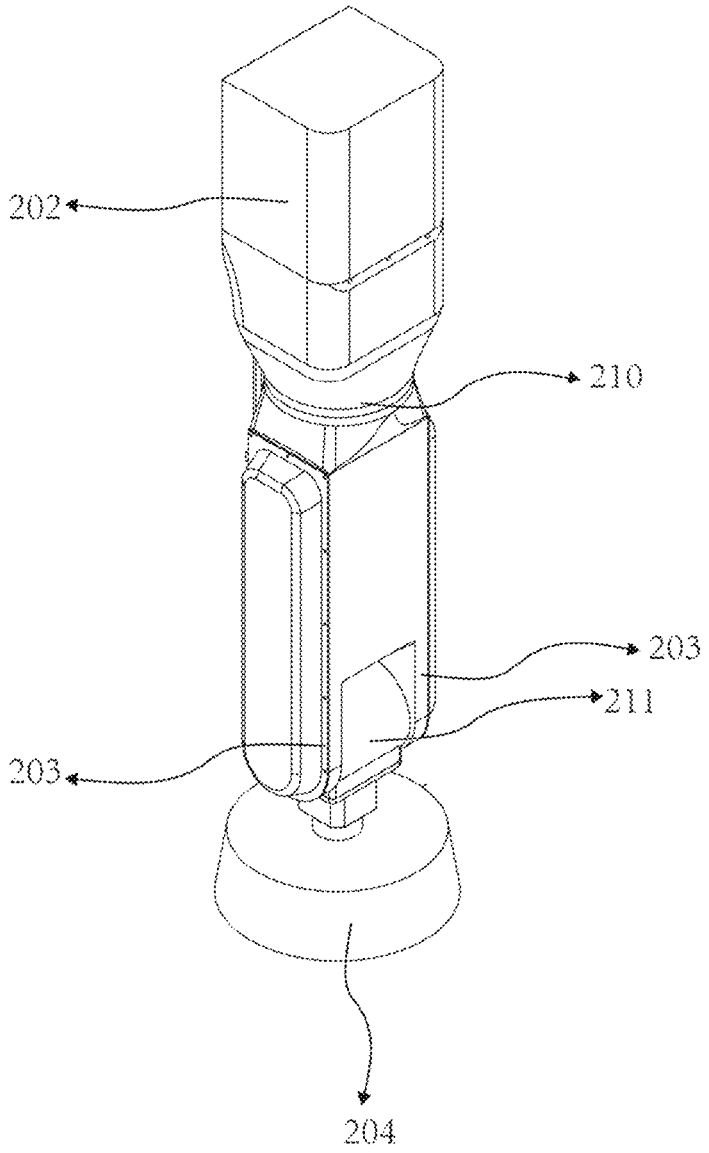
FIG. 2 is a schematic diagram illustrating some components of an automated polishing system according to certain embodiments of the present disclosure.

As shown in FIG. 2, the automated polishing system includes two polishing unit 200 which are arranged in order along a moving direction of the transport surface and separated from each other. The polishing unit 200 includes a base 201, polishing shaft 206, supporting portion 202, holding arm, holder 204 and a polishing rotating device configured to drive the polishing shaft 206. The polishing rotating device may be a motor 205 connected to the polishing shaft 206 and configured to drive the polishing shaft 206 to run. The holding arm is rotatably connected to the supporting portion 202. The holding arm is provided with two holding portions 203 which are separated from each other, and the holder is hinged between the two holding portions 203 through hinges.

Figure 3:
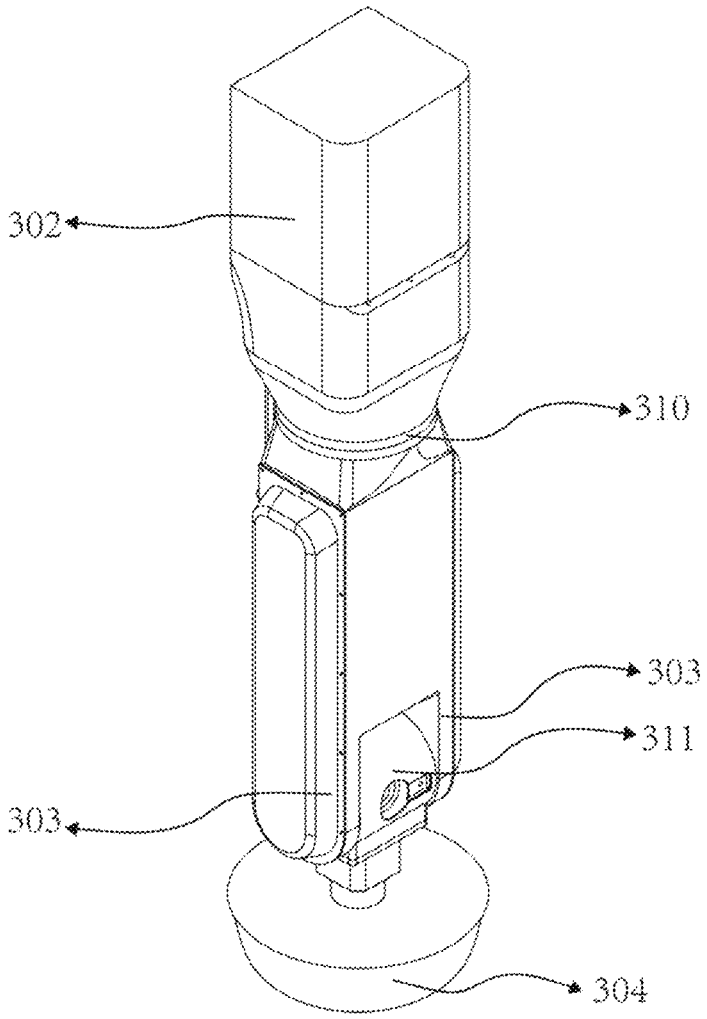
FIG. 3 is a schematic diagram illustrating some components of an automated polishing system according to certain embodiments of the present disclosure.

As shown in FIG. 3, the polishing unit includes a base 301, a polishing shaft 306, a supporting portion 302, holding arm, holder 304 and a polishing rotating device configured to drive the polishing shaft 306. The polishing rotating device may be a motor 305 connected to the polishing shaft 206 and configured to drive the polishing shaft 306 to run. The holding arm is rotatably connected to the supporting portion 302. The holding arm is provided with two holding portions 303 which are separated from each other. The holder 304 is provided with a connecting portion hinged between the two holding portions 303 through hinges, and the holder 304 may rotate relative to the holding arm.

Further, a sliding guide rail is also provided, through which the motor 205 is connected to the base 201. The polishing unit is provided with a polishing drive (not shown) configured to drive the polishing shaft 206 and the motor 205 to move towards the holder 204 for reciprocating motion, that is, the motor 205 and the polishing shaft 206 may move towards the holder 204 along a direction perpendicular to the moving direction of the transport surface for reciprocating motion to adjust the position of the polishing shaft 206. The base 201 is connected to the workbench 100, and the height of the base 201 is adjusted so that the position of the polishing shaft 206 is above the plane where the front end transport surface 400 and the turnover transport surface 401 are located. The motor 305 is connected to the base 301 through the sliding guide rail. The polishing unit is provided with a polishing drive (not shown) configured to drive the motor 305 and the polishing shaft 306 to move towards the holder 304 along a direction perpendicular to the moving direction of the transport surface for reciprocating motion to adjust the position of the polishing shaft 306. The base 301 is connected to the workbench 100, and the height of the base 301 is adjusted so that the position of the polishing shaft 306 is above the plane where the front end transport surface 400 and the turnover transport surface 401 are located.

The polishing unit 200 also includes a horizontal drive 208 configured to drive the supporting portion 202 to move horizontally, a vertical drive 209 configured to drive the supporting portion 202 to move vertically, a horizontally rotating drive 210 configured to drive the holding arm to rotate in a horizontal direction, a vertically rotating drive 211 configured to drive the holder 204 to rotate in a vertical direction, and a rotating drive (not shown) configured to drive the holder 204 to rotate relative to the holding arm. The polishing unit 300 also includes a horizontal drive 308 configured to drive the supporting portion 302 to move horizontally, a vertical drive 309 configured to drive the supporting portion 302 to move vertically, a horizontally rotating drive 310 configured to drive the holding arm to rotate in a horizontal direction, a vertically rotating drive 311 configured to drive the holder 304 to rotate in a vertical direction, and a rotating drive (not shown) configured to drive the holder 304 to rotate relative to the holding arm.

The polishing shaft 206 is located between the front end transport surface 400 and the turnover transport surface 401, and the polishing shaft 306 is located between the turnover transport surface 401 and the material receiving transport surface 402.

Further, the polishing unit 200 also includes an air suction component (not shown), and the air suction component is provided with an air suction opening arranged at the end of the holder 204. The polishing unit 300 also includes an air suction component (not shown), and the air suction component is provided with an air suction opening arranged at the end of the holder 304.

In the embodiment, as shown in FIGS. 2 and 3, the holder 204 is different from the holder 304. The holder 204 matches the outside of the object to be polished 600, and the holder 204 is in a cylinder shape wherein the inner edge of the cylindrical holder 204 is arranged on the outer wall of the object to be polished 600, contacts and matches the outer wall of the object to be polished 600. The holder 304 matches the inside of the object to be polished 600, and the holder 304 is in a cylinder shape wherein the outer edge of the cylindrical holder 304 is arranged on the inner wall of the object to be polished 600, contacts and matches the inner wall of the object to be polished 600.

The control unit is connected to the transport drive, the polishing rotating device (motor 205, 305), the polishing drive, the horizontal drive 208, 308, the vertical drive 209, 309, the horizontally rotating drive 210, 310, the vertically rotating drive 211, 311 and the rotating drive.

Figure 4:
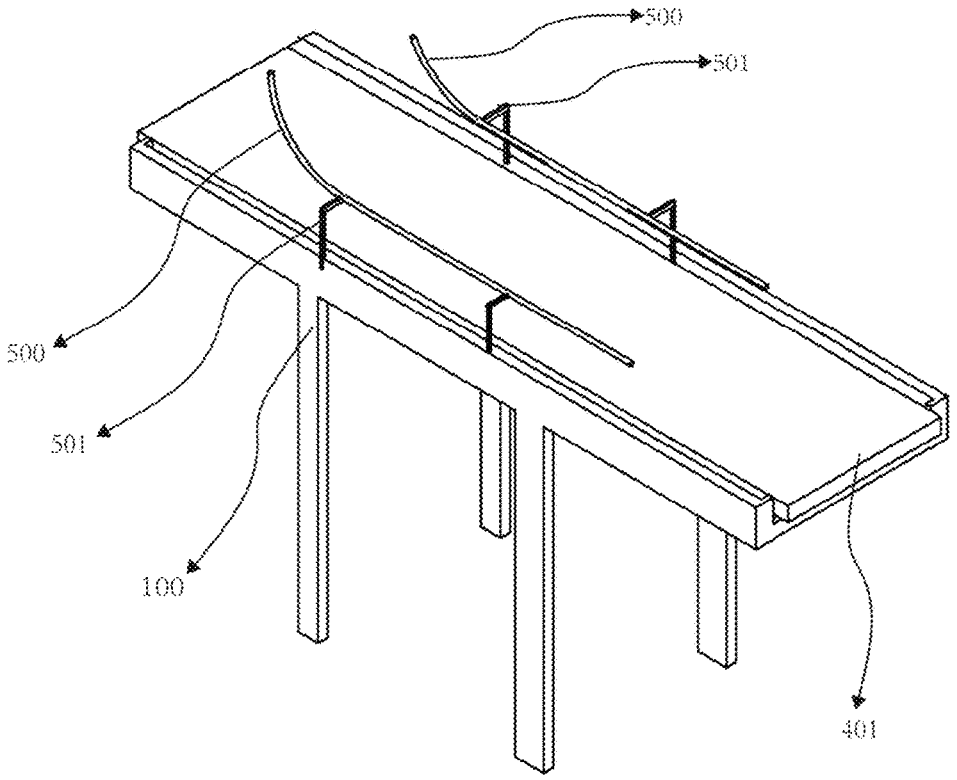
FIG. 4 is a schematic diagram illustrating a workbench and a turnover unit of an automated polishing system according to certain embodiments of the present disclosure.
Figure 5:
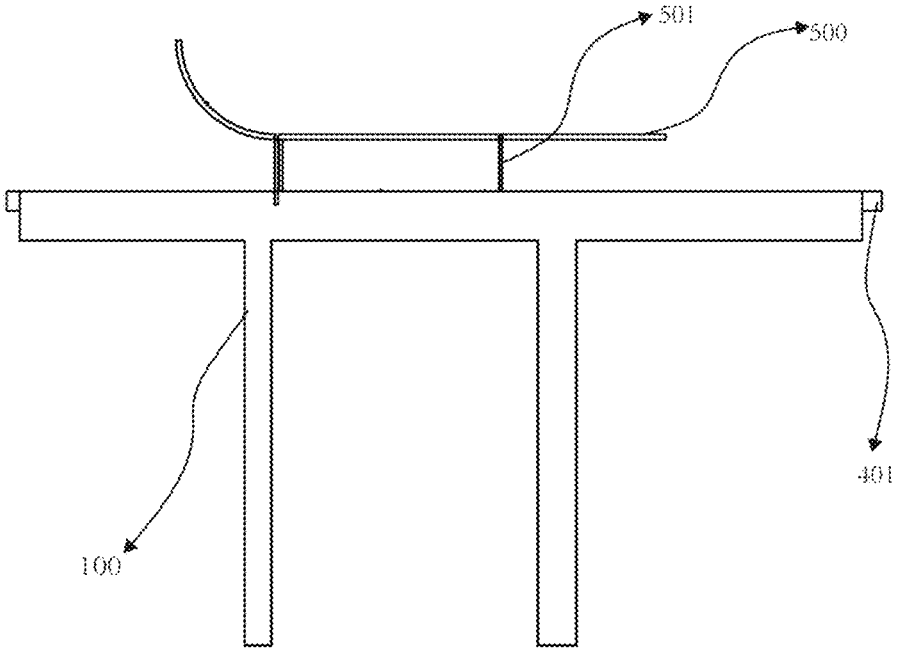
FIG. 5 is a side view illustrating a workbench and a turnover unit of an automated polishing system according to certain embodiments of the present disclosure

Further, as shown in FIGS. 4 and 5, the automated polishing system also includes a turnover unit located between the two polishing units 200, 300 in a horizontal direction. The turnover unit is provided with two connecting parts 501, and two guide rails 500 which are fixed on the workbench 100 through the connecting parts 501 respectively, arranged above the turnover transport surface 401, and separated from each other, and one end of each guide rail 500 at the same end is curved upwards from a plane where the guide rails 500 are located, so that the guide rails 500 are in a shape of a diminishing curve along the moving direction of the transport surface.

Further, each of the connecting parts 501 of the turnover unit is provided with a retractable component configured to adjust the distance between the guide rails 500 and the turnover transport surface 401.

The head of the curved end of the two guide rails 500 has a distance to the turnover transport surface 401 larger than the thickness of the object to be polished 600, and a plane where the other end of the two guide rails 500 are placed, parallel to the transport surface, has a distance to the transport surface less than the thickness of the object to be polished 600. The distance between the two guide rails 500 is less than the horizontal width of the object to be polished 600.

An automated polishing method is also provided, including the followings steps.

Figure 6:
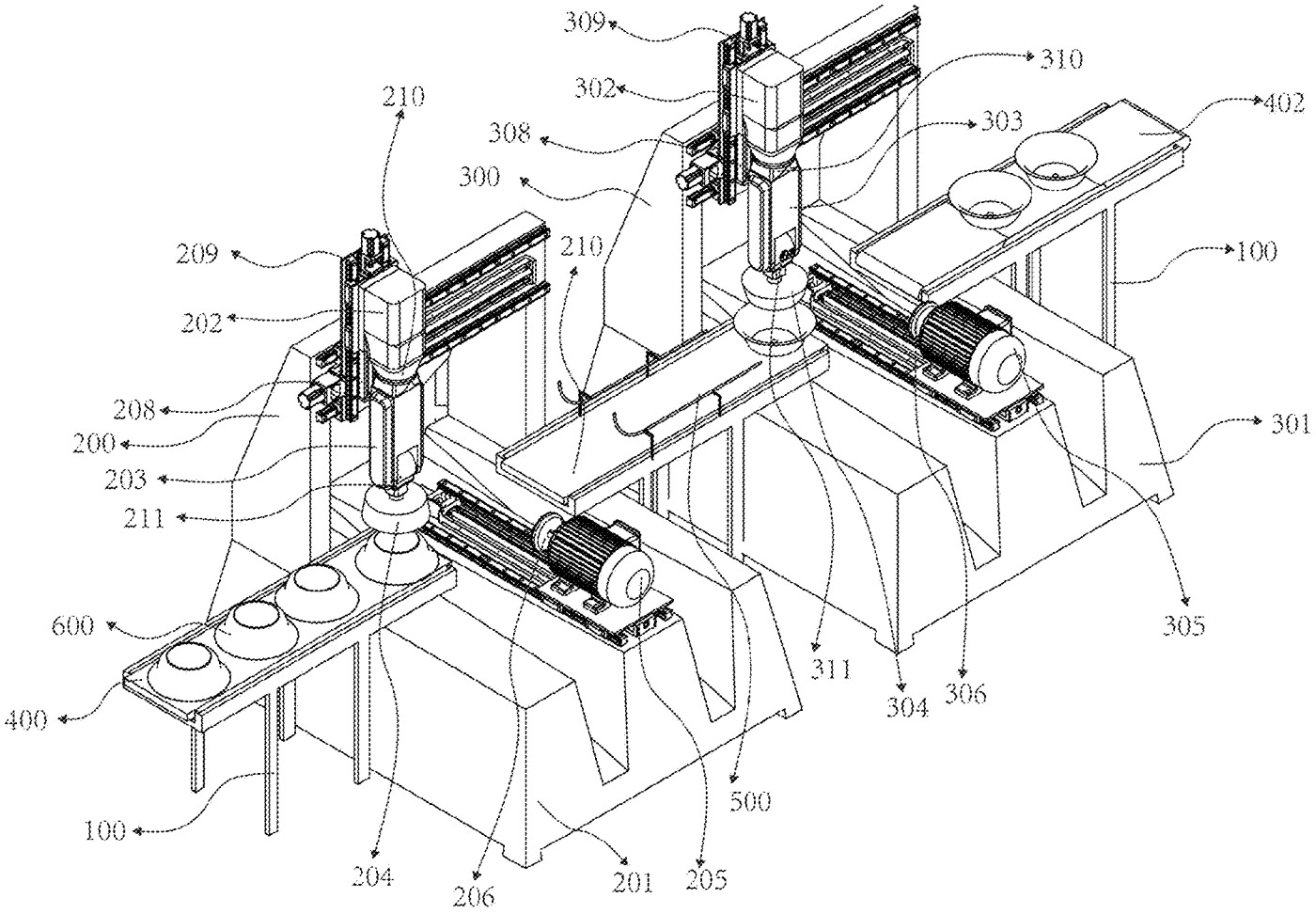
FIG. 6 is a schematic diagram illustrating an automated polishing system before holding a material according to certain embodiments of the present disclosure.

As shown in FIG. 6, the objects to be polished 600, for example, bowls with a flanging in the embodiment, are placed on the front end transport surface 400 in turn, the first surface (upper surface) of the object to be polished 600 faces the front end transport surface 400, and the second surface (lower surface) of the object to be polished 600 is vertically upward. The control unit may control the transport drive to drive the front end transport surface 400 to move, and the turnover transport surface 401 and the material receiving transport surface 402 may also move at the same sheep as the front end transport surface 400.

Figure 7:
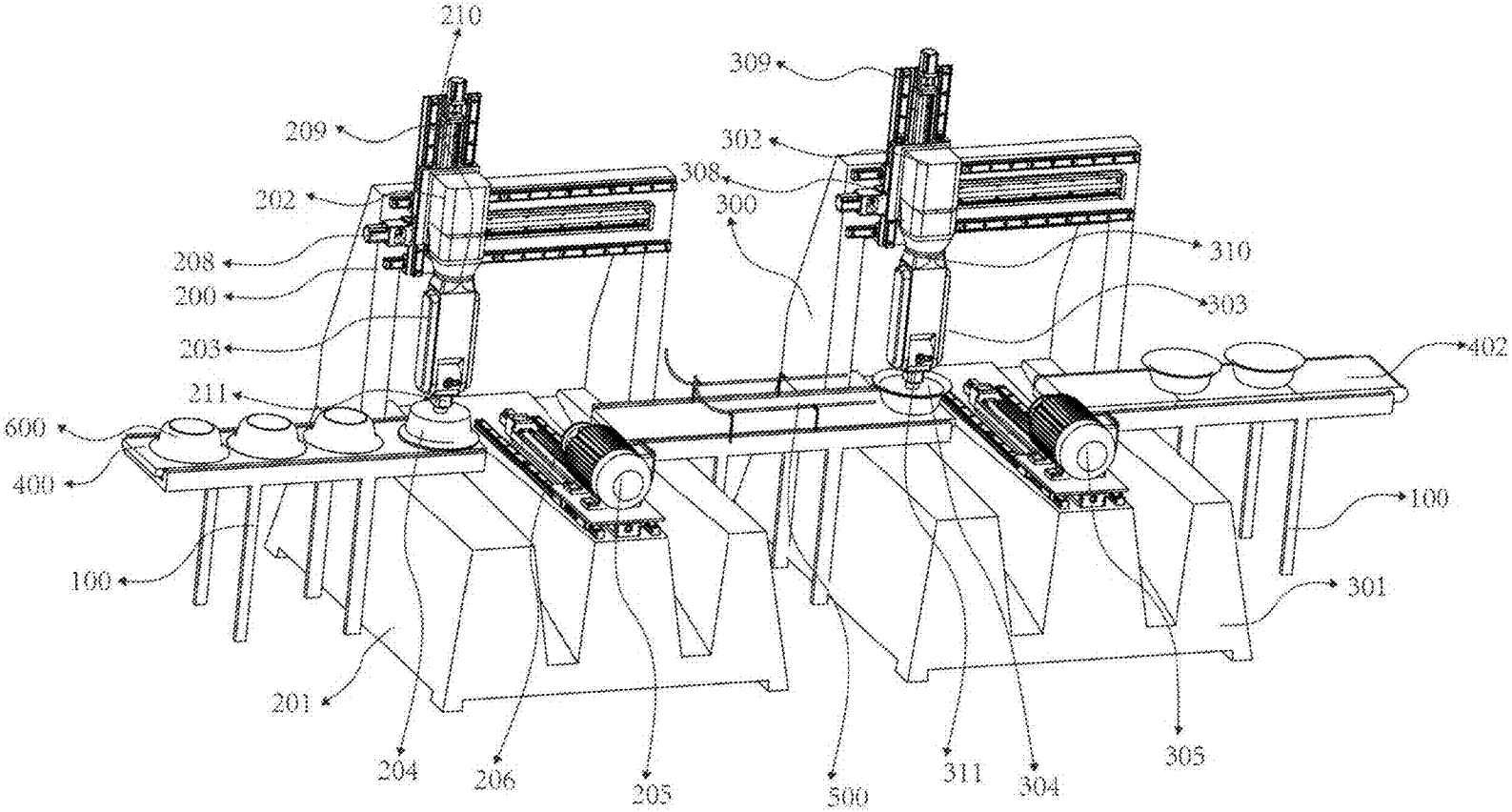
FIG. 7 is a schematic diagram illustrating an automated polishing system after holding a material according to certain embodiments of the present disclosure.

As shown in FIG. 7, when the first object to be polished 600 is transported to a preset position, the control unit may control the horizontal drive 208 of the first polishing unit 200 to drive the supporting portion 202 of the first polishing unit 200 to move horizontally to the top of the object to be polished 600, control the vertical drive 209 of the first polishing unit 200 to drive the supporting portion 202 to move downward till the holder 204 at the end of the holding arm of the first polishing unit 200 holding the object to be polished 600, control the horizontal drive 208 and the vertical drive 209 of the first polishing unit 200 to work together to drive the object to be polished 600 to be transported to a position where the polishing shaft 206 of the first polishing unit 200 is located, and control the vertically rotating drive 211 of the first polishing unit 200 to drive the object to be polished 600 to rotate in a vertical direction to make the first surface (upper surface) of the object to be polished 600 face towards the polishing end of the polishing shaft 206.

Figure 8:
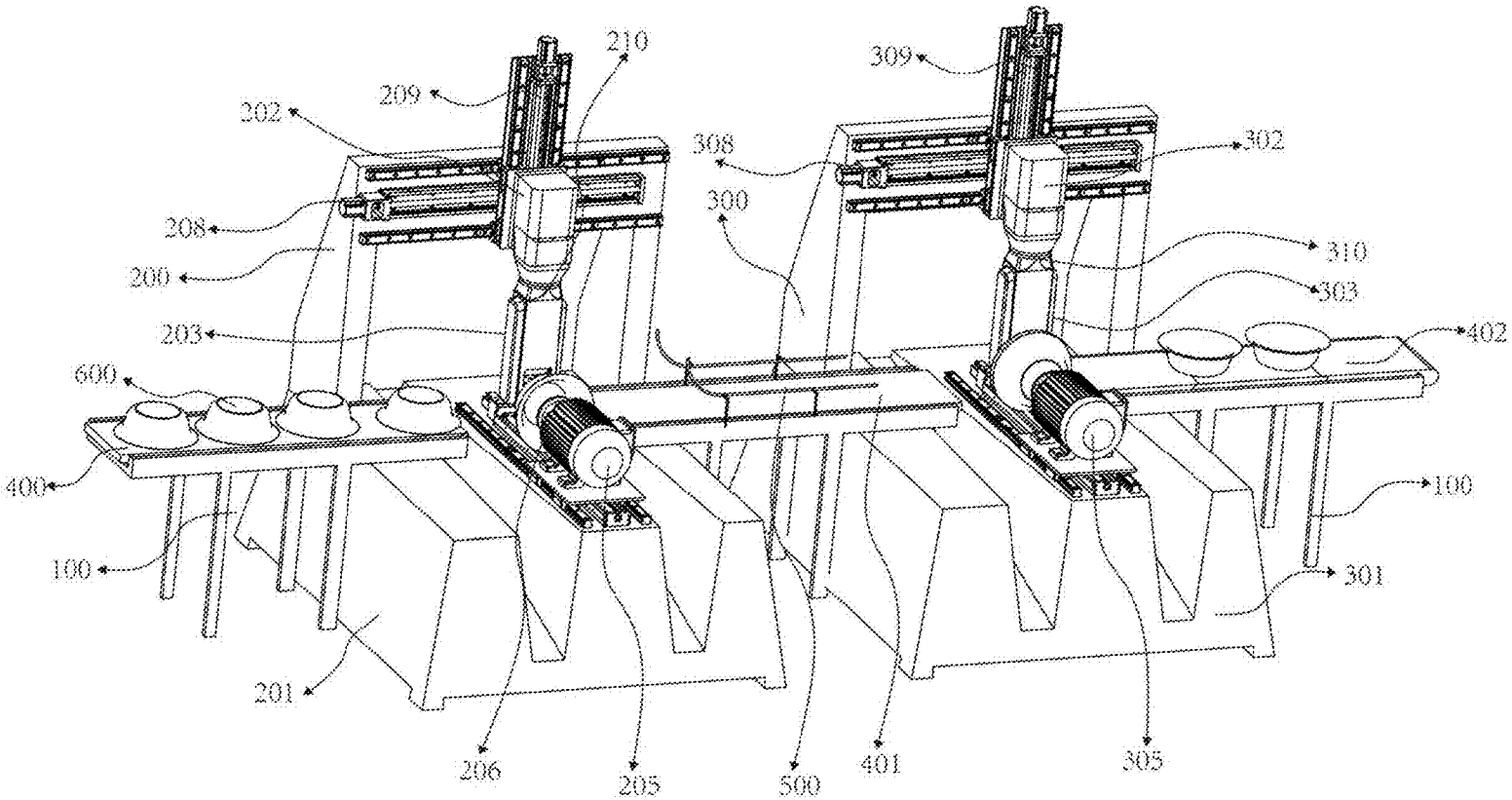
FIG. 8 is a schematic diagram illustrating an automated polishing system when polishing according to certain embodiments of the present disclosure.

As shown in FIG. 8, the control unit may control the polishing rotating device of the first polishing unit 200 to drive the first polishing shaft 206 to run for polishing, and control the rotating drive to drive the holder 204 to rotate relative to the holding arm. When the curved surface of the object to be polished 600 is to be polished, the polishing drive may drive the polishing shaft to move towards the holder 204 (the object to be polished 600), and the horizontal drive 208 and the vertical drive 209 may drive the holder 204 together for horizontal and vertical movements to make the polishing shaft 206 close to the surface to be polished of the object to be polished 600.

Figure 10:
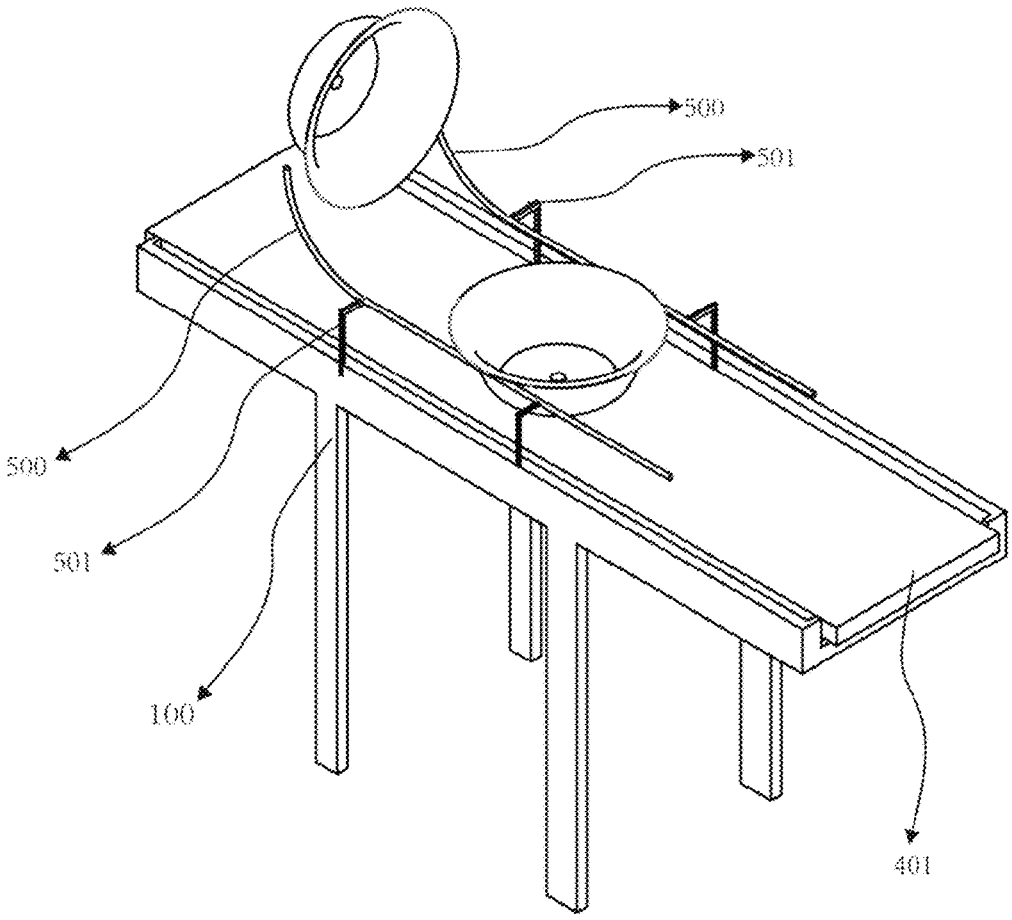
FIG. 10 is a schematic diagram illustrating a turnover unit of an automated polishing system during operation according to certain embodiments of the present disclosure.
Figure 11:
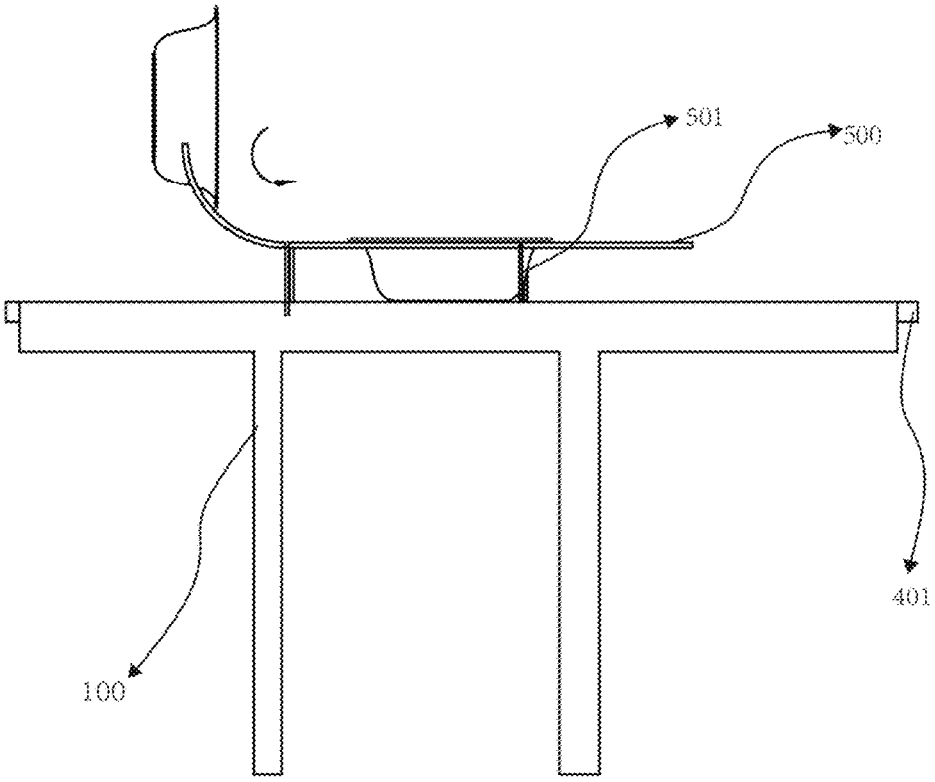
FIG. 11 is a side view illustrating a turnover unit of an automated polishing system during operation according to certain embodiments of the present disclosure.

After polishing, the control unit may control the horizontal drive 208 and the vertical drive 209 of the first polishing unit 200 to transport the object part of which has been polished to the curved end of the guide rails 500 of the turnover unit, as shown in FIGS. 10 and 11. Meanwhile, the horizontally rotating drive 210 may drive the first holding arm to move horizontally so that the first surface (upper surface) of the object part of which has been polished faces toward the moving direction of the turnover transport surface 401. After the object part of which has been polished reaching the curved end of the guide rails 500, the control unit may control the holder 204 of the first polishing unit 200 to release the object part of which has been polished, and the holding arm and holder 204 of the first polishing unit 200 may return to their original positions. At this moment, the first surface (upper surface) of the object part of which has been polished is vertically upward, and the second surface (lower surface) of the object part of which has been polished faces the turnover transport surface 401, after the object part of which has been polished has been turned over by the turnover unit.

When the object part of which has been polished reaches the transport end of the turnover transport surface 401, the control unit may control the horizontal drive 308 of the second polishing unit 300 to drive the supporting portion 302 to move horizontally to the top of the object part of which has been polished, control the vertical drive 309 of the second polishing unit 300 to drive the supporting portion 302 of the second polishing unit 300 to move downward till the holding arm of the second polishing unit 300 holding the object part of which has been polished, control the horizontal drive 308 and the vertical drive 309 of the second polishing unit 300 to work together to drive the object part of which has been polished to be transported to a position where the polishing shaft 306 of the second polishing unit 300 is located, and control the vertically rotating drive 311 of the second polishing unit 300 to drive the object part of which has been polished to rotate in a vertical direction to make the second surface (lower surface) of the object to be polished 600 face towards the polishing end of the polishing shaft 306.

Figure 9:
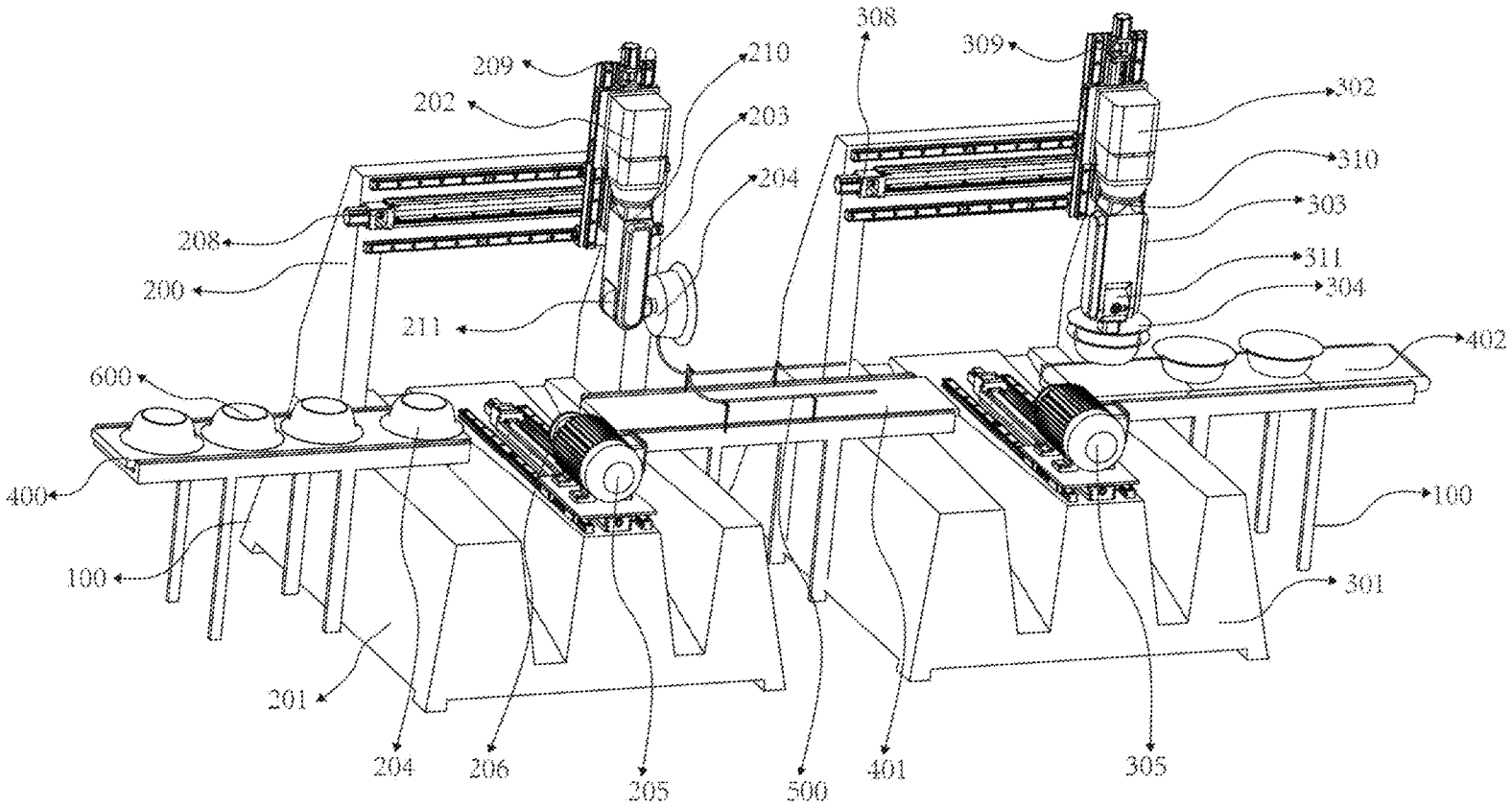
FIG. 9 is a schematic diagram illustrating an automated polishing system after polishing according to certain embodiments of the present disclosure.

As shown in FIG. 9, the control unit may control the polishing rotating device of the second polishing unit 300 to drive the second polishing shaft 306 to run for polishing, and control the rotating drive to drive the holder 304 to rotate relative to the holding arm. When the curved surface of the object to be polished 600 is to be polished, the polishing drive may drive the polishing shaft to move towards the holder 304 (the object to be polished 600), and the horizontal drive 308 and the vertical drive 309 may drive the holder 304 together for horizontal and vertical movements to make the polishing shaft 306 close to the surface to be polished of the object to be polished 600.

After polishing, the control unit may control the horizontal drive 308 and the vertical drive 309 of the second polishing unit 300 to transport the object which has been polished to the material receiving transport surface 402. Meanwhile, driven by the vertically rotating drive 311 of the second polishing unit 300, the object which has been polished may be rotated in reverse in a vertical direction (down toward the material receiving transport surface 402), so that the second surface (lower surface) of the object to be polished 600 faces toward the material receiving transport surface 402 (the plane where the turnover transport surface 401 is originally located), and the horizontally rotating drive 310 may drive the second holding arm to move horizontally, so that the second surface (lower surface) of the object which has been polished rotates horizontally towards the moving direction of the material receiving transport surface 402. The control unit may control the holder 304 of the second polishing unit 300 to release the object which has been polished, and the holding arm and holder 304 of the second polishing unit 300 may return to their original positions. At this moment, the second surface (lower surface) of the object which has been polished faces the material receiving transport surface 402, and the first surface (upper surface) of the object which has been polished is vertically upward.

During the whole process of polishing, the control unit may control the transport drive, and the polishing rotating devices, the horizontal drives 208, 308, the vertical drives 209, 309, the horizontally rotating drive 210, 310 and the vertically rotating drive 211, 311 to act in unison and keep synchronous.

In addition, in other embodiments, the horizontally rotating drive 310 may be omitted, and the step that horizontally rotating drive 310 drives the second holding arm to move horizontally so that the second surface (lower surface) of the object which has been polished rotates horizontally towards the moving direction of the material receiving transport surface 402 can also be omitted.

The automated polishing system according to the present invention can automatically transport the object to be polished using the transport surface of the transport unit, hold up and fix the object to be polished using the holding arm and the holder of the polishing unit, and achieve a multi-angle and multi-plane rotation of the object to be polished using the horizontal drive, the vertical drive, the horizontally rotating drive and the vertically rotating drive, resulting in precise polishing and high accuracy. The automated polishing system can achieve the holding up of the object to be polished, the polishing and the feeding automatically, without human intervention, which can allow the worker to reduce direct contact with the polishing unit, avoid the direct short distance contact between the worker and the polishing material, and greatly protect the worker's health. The polishing equipment requires a low cost investment, and is low in cost, which can further save labor cost and time cost.

When the automated polishing system includes two polishing units, the two polishing units are arranged in order along a moving direction of the transport surface and separated from each other. With the configuration of the two polishing units, more than one surfaces of the object to be polished can be polished in one processing cycle, to solve the technical problem about time-consuming redundant operations for the polishing material in which a plurality of surfaces are required to be polished, and also shorten the time for the worker contacting with the machine. When the first polishing unit completes the polishing of one surface, the second polishing unit continues to implement the polishing of another surface, and the process between the switching from the first polishing unit to the second polishing unit requires no human intervention, which can be completed with the help of the holders and holding arms of the two polishing units. In this way, the worker's health can be further protected, the time can be further saved, and the polishing efficiency can be greatly improved. With the configuration of the turnover unit, it can achieve automatic turn-over completely in a process when the first polishing unit has completed the polishing of one surface and the second polishing unit continues to implement the polishing of the another surface, without additional machine or device for turning over. That is, the automatic turn-over of the object to be polished can be implemented by the cooperation of the two guide rails of the turnover unit, and the horizontal drive, vertical drive, horizontally rotating drive and vertically rotating drive of the polishing unit, to save the cost of the investment on equipment.

The above preferred embodiments of the present invention are described in detail, and should not be deemed as limitations to the scope of the present invention. It should be noted that variations and improvements will become apparent to those skilled in the art to which the present invention pertains without departing from its spirit and scope. Therefore, the scope of the present disclosure is defined by the appended claims.

The invention claimed is:

1. An automated polishing system, comprising:

a workbench;

a transport unit provided with a transport surface and a transport drive configured to drive the transport surface to move horizontally;

two polishing units fixed on the workbench arranged in order along a moving direction of the transport surface and separated from each other, each of the two polishing units including: (i) a supporting portion, a holding arm rotatably connected to the supporting portion, and a holder rotatably connected to the holding arm for holding an object to be polished; (ii) a horizontal drive configured to drive the supporting portion to move horizontally, a vertical drive configured to drive the supporting portion to move vertically, a horizontally rotating drive configured to drive the holding arm to rotate in a horizontal direction, a vertically rotating drive configured to drive the holder to rotate about a hinged connection with the holding arm in a vertical direction to make a surface of the object to be polished face towards a polishing shaft, and a rotating drive configured to drive the holder to rotate relative to the holding arm; and (iii) a polishing rotating device configured to drive the polishing shaft, and a polishing drive configured to drive the polishing shaft to move towards the holder for reciprocating motion;

a control unit connected to the transport drive, the polishing rotating device, the polishing drive, the horizontal drive, the vertical drive, the horizontally rotating drive, the vertically rotating drive and the rotating drive; and a turnover unit located between the two polishing units in a horizontal direction, wherein the turnover unit is provided with two connecting parts and two guide rails which are fixed on the workbench through the connecting parts respectively, arranged above the transport surface, and separated from each other, and one end of each guide rail at the same end is curved upwards from a plane where the guide rails are located, so that the guide rails are in a shape of a diminishing curve along the moving direction of the transport surface.

2. The automated polishing system of claim 1, wherein the transport surface of the transport unit comprises a front end transport surface, a turnover transport surface and a material receiving transport surface; and the front end transport surface, the turnover transport surface and the material receiving transport surface are arranged in order in a horizontal direction, two polishing shafts are arranged between the front end transport surface and the turnover transport surface, and the turnover transport surface and the material receiving transport surface, respectively, and the two guide rails are arranged above the turnover transport surface.

3. The automated polishing system of claim 2, wherein each of the connecting parts of the turnover unit is provided with a retractable component configured to adjust the distance between the guide rails and the turnover transport surface.

4. The automated polishing system of claim 2, wherein the head of the curved end of the two guide rails has a distance to the turnover transport surface larger than the thickness of the object to be polished, and a plane where the other end of the two guide rails are located, parallel to the transport surface, has a distance to the transport surface less than the thickness of the object to be polished.

5. The automated polishing system of claim 1, wherein a distance between the two guide rails is less than a horizontal width of the object to be polished.

6. The automated polishing system of claim 1, wherein the polishing unit further comprises an air suction component provided with an air suction opening arranged at the end of the holder.

7. The automated polishing system of claim 1, wherein the holding arm is provided with two holding portions which are separated from each other, and the holder is hinged between the two holding portions through hinges.

8. An automated polishing system, comprising:

a workbench;

a transport unit provided with a transport surface and a transport drive configured to drive the transport surface to move horizontally;

a polishing unit fixed on the workbench, including a supporting portion, a holding arm rotatably connected to the supporting portion, a holder connected to the holding arm, a horizontal drive configured to drive the supporting portion to move horizontally, a vertical drive configured to drive the supporting portion to move vertically, a horizontally rotating drive configured to drive the holding arm to rotate in a horizontal direction, a vertically rotating drive configured to drive the holder to rotate in a vertical direction, a rotating drive configured to drive the holder to rotate relative to the holding arm, a polishing shaft, a polishing rotating device configured to drive the polishing shaft, and a polishing drive configured to drive the polishing shaft to move towards the holder for reciprocating motion;

a control unit connected to the transport drive, the polishing rotating device, the polishing drive, the horizontal drive, the vertical drive, the horizontally rotating drive, the vertically rotating drive and the rotating drive;

two polishing units arranged in order along a moving direction of the transport surface and separated from each other; and a turnover unit located between the two polishing units in a horizontal direction, and the turnover unit provided with two connecting parts and two guide rails which are fixed on the workbench through the connecting parts respectively, arranged above the transport surface, and separated from each other, and one end of each guide rail at the same end is curved upwards from a plane where the guide rails are located, so that the guide rails are in a shape of a diminishing curve along the moving direction of the transport surface.

* * * * *